United States Patent [19]

La Tour

[11] 4,137,673

[45] Feb. 6, 1979

[54] SKI DRESSING APPARATUS

[76] Inventor: Barry La Tour, Drawer 2139, Olympic Valley, Calif. 95730

[21] Appl. No.: 679,680

[22] Filed: Apr. 23, 1976

[51] Int. Cl.[2] ..... B24B 21/06

[52] U.S. Cl. ..... 51/139; 51/141

[58] Field of Search ..... 51/139, 141, 170 EB, 51/328, 228; 76/83

[56] References Cited

U.S. PATENT DOCUMENTS

| | | | |
|---|---|---|---|
| 2,060,266 | 11/1936 | Thompson | 51/141 X |
| 2,384,777 | 9/1945 | Westman | 51/141 X |
| 2,416,493 | 2/1947 | Newton | 51/141 |
| 2,677,922 | 5/1954 | McGuire | 51/139 |
| 2,761,256 | 9/1956 | O'Connor | 51/141 X |
| 3,283,447 | 11/1966 | Cretsinger | 51/141 |
| 3,888,050 | 6/1975 | Elm | 51/141 X |

FOREIGN PATENT DOCUMENTS

| | | | |
|---|---|---|---|
| 1963658 | 9/1971 | Fed. Rep. of Germany | 51/228 |

*Primary Examiner*—Nicholas P. Godici
*Attorney, Agent, or Firm*—Herbert C. Schulze

[57] ABSTRACT

This is an apparatus for performing the method for dressing, or finishing the bottom surfaces and edges of skis, or the like, featuring the use of belt sanders wherein the sanding belt runs over an elongated platen, which platen has means to flex at its center so as to provide a curvature bearing surface, in which the ski bottoms are dressed to an even and flat surface across their widths.

1 Claim, 13 Drawing Figures

FIG 7A
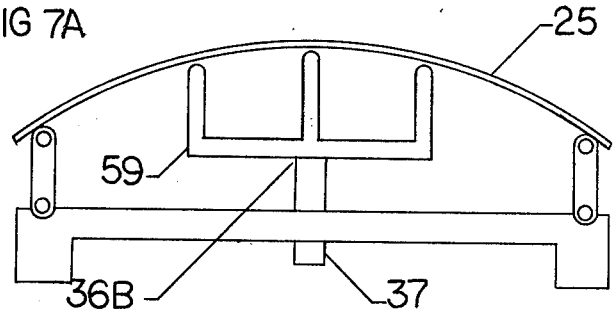
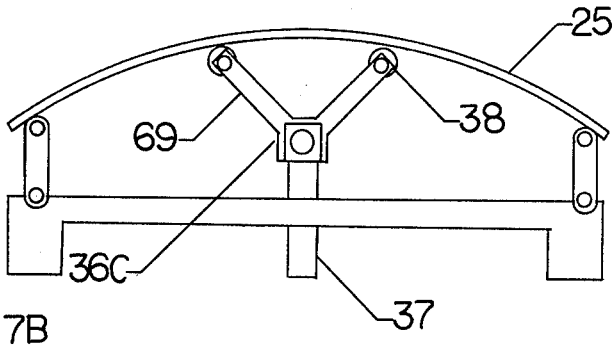
FIG 7B
FIG. 7
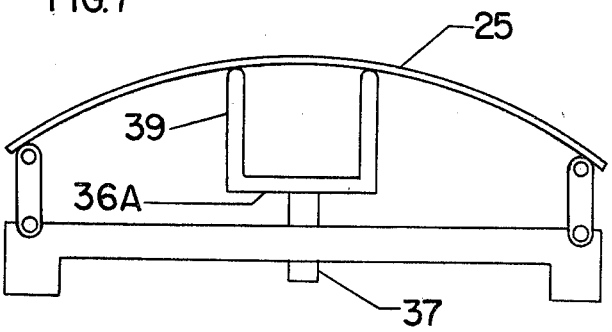

SKI DRESSING APPARATUS

BACKGROUND OF THE INVENTION

1. FIELD OF THE INVENTION

This invention is in the general field of the dressing or finishing of flat members, skis in particular, and is more particularly related to a method and the apparatus for finishing skis so that the finished surface is absolutely flat and without curvature across its width. The invention is further in the field of belt sanders and more particularly relates to a belt sander having a unique platen crowning method and means.

2. DESCRIPTION OF THE PRIOR ART

The dressing or finishing of the bottom of skis, and the like, is normally performed in its final stages by sanding on a machine of some type or the like. Such dressing can also be provided by such devices as milling machines or the like.

Particularly when old used skis are involved, it is customary to use various types of sanding devices from hand sanding to machine sanding utilizing belts or drums carrying the appropriate sand paper.

Up until now, the use of an abrasive belt running over a flat platen has been a most preferable means for accomplishing the refinishing or finishing of skis. The platen will allow the exertion of pressure upon the belt which runs between the platen and the ski. Belt sanders of this nature are well known in the art and normally consist of two pulleys, one of which is normally under tension, and one of which is driven by a motor or the like, and wherein a platen, or support member, is placed beneath the non sanding surface of the belt so that the item being sanded may be pressed against the platen with pressure as desired. Such belt sanding customarily results in a slight crown, or curvature, to the bottom of the ski across its width.

The present invention, and this patent application, are directed to a method and apparatus for flexing the platen in such manner as to insure a curvature surface. There is no art known to us in the method and apparatus herein described. In this sense, therefore, it can be said that there is not prior art to this specific method and apparatus.

I am aware of a belt sanding machine with a fixed curvature platen which is not adjustable and since the bite surface is small there is "washboarding" which results in an uneven surface.

SUMMARY OF THE INVENTION

Skiing is a sport which has grown rapidly in popularity throughout the world in the last few years. The result of the rapid and excessive growth of the sport has put a great emphasis upon the perfection of equipment for skiing, including the perfection of ski design and maintenance.

Among other things, it has been found that if the bottom surface of the ski is maintained perfectly flat across its width at any point, the safety, effectiveness, and enjoyment of skiing is greatly enhanced.

It has also been found that by making the angular relationship of the ski edges with the bottom of the ski slightly acute, increased effectiveness of stopping, turning, and the like can be achieved.

By the use of certain expensive electronic milling equipment, it is possible, in factories or the like, to provide, with relative economy and effectiveness, the ski bottoms and edges which are most desirable. Most of such equipment, however, is expensive.

Used skis are brought to ski repair shops for refinishing after the skis have been used for some period of time, and frequently after having been somewhat damaged along the bottom and side surfaces by reason of skiing over material which will damage the surfaces. In these ski repair shops it is not possible to have the highly sophisticated equipment necessary to achieve the perfect results required, since most ski shops use inferior belt sanders, or the like, to attempt to achieve a finish as nearly perfect as possible. Due to the tendency of a belt to curl at its edges when passing over a flat platen, and the like, the result is usually a finished ski bottom with a slight curvature in the finished surface. Likewise, it is difficult to achieve an acute angle at the ski edges because of this curvature.

The reason is that most belt sanders roll over a flat supporting member which we refer to as a platen. The platen, in being flat, causes curling along the edges of the belt, as described, and does not result in a flat finished surface across the width of the ski.

In finishing a ski on an abrasive covered pulley made of soft material, there is a tendency for the hard edges of the ski to press into the pulley to an extent greater than the center of the ski and the result is a concave finish on the bottom of the ski.

It has been found that a flat platen will receive greater pressure at each end with the result being an excessive heat build up at that point.

I have performed many experiments and have now devised a method, and an apparatus for performing the method, wherein we actually flex the platen, preferably near its center point, in such a manner that the belt flexes upwardly from its normal path of travel between the pulleys and in this manner maintains the edges of the belt in a totally flat condition so that the bottom of the ski, or the like, which comes in contact with the belt, receives an absolutely flat finished surface across its entire width.

By turning the ski on its edge and holding its bottom surface against a specially designed and constructed guide, a desired acute angle is easily finished since the absolutely flat bottom of the ski is pressing firmly against the flat guide.

Having once designed and perfected the basic system, I have further discovered that it is generally preferable to use more than one sanding belt, usually utilizing a coarse grit first, and finishing with a second sanding belt utilizing a finer grit.

By the use of our method and apparatus, I am able to greatly reduce the time required to properly refinish a ski, and I am able to obtain a uniform flat surface across the bottom of the ski as well as to accurately form edges according to the angles desired.

Excessive experimentation has proven that the best results of finishing are accomplished on a drum or wheel of enormous radius. By curving the platen, we can simulate a portion of the arc of a wheel having a diameter up to approximately 40 feet with the result being a bite large enough to eliminate "washboarding".

It is an object of this invention to provide a method and apparatus for dressing the bottom of skis in such manner that the bottoms are flat across their width at any given point;

Another object of this invention is to provide a method and apparatus for insuring accuracy of edge angles imparted to skis and the like during dressing operations;

Another object of this invention is to accomplish the foregoing by utilizing a belt sander having a platen, wherein the platen is flexed in such manner that the belt remains perfectly flat across the platen;

Another object of this invention is to provide a method and apparatus as above described wherein a pair of belt sanders with adjustable platens, as described, are utilized, one of which uses a coarse grit and the other of which uses a fine grit;

Another object of this invention is to provide a method and apparatus wherein multiple abrasive belts of different grits are placed in series and by use of an automatic feeding device and drive roller, the finishing operation is entirely automatic.

The foregoing and other objects and advantages of this invention will be clear to those skilled in the art upon reading the following description of a preferred embodiment in conjunction with a review of the appended drawings.

BRIEF DESCRIPTION OF THE DRAWINGS

FIGS. 7, 7*a* and 7*b* display some alternative means for regulating curvature of the platen; and, FIG. 8 is a perspective view of a machine used for automatic feeding of the skis by use of a drive roller.

DESCRIPTION OF A PREFERRED EMBODIMENT

Figure 1:
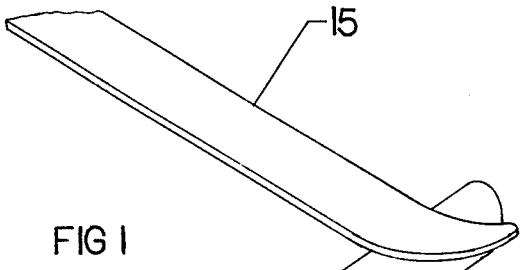
FIG. 1 is a perspective view of a ski bottom being refinished on an abrasive coated drum of small radius.
Figure 2:
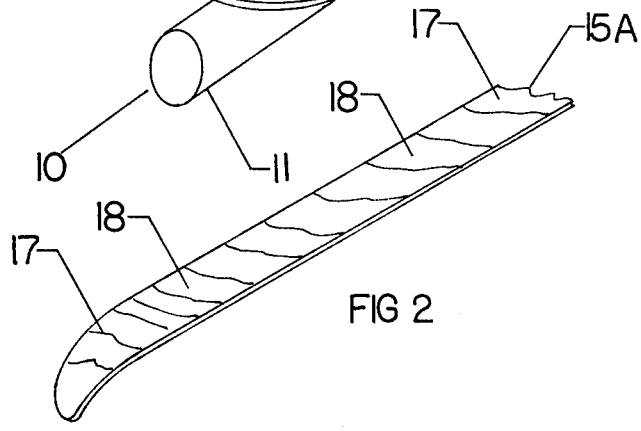
FIG. 2 is a perspective view of the ski of FIG. 1 showing the finished bottom surface.

FIGS. 1 and 2 illustrate the fact that when a ski 15, 15*a*, or a similar type flat surface, is refinished on a drum type wheel or pulley 10 of small radius, the "bite", or amount of surface in contact with the abrasive 11 on the wheel, is so small that indentations 18 will predominate causing a "washboard" effect. Further, if the drum 10 is of a soft plyable material, such as rubber, a concave finish 17 will result since the bottom outer ski edges will tend to press further into the wheel than will the inner portion of the ski bottom.

However, an embodiment of this invention can contain means to cause a cushion of air to flow between the drum and the belt or the platen and the belt so as to eliminate uneven surfaces and so as to eliminate other problems being encountered.

Figure 3:
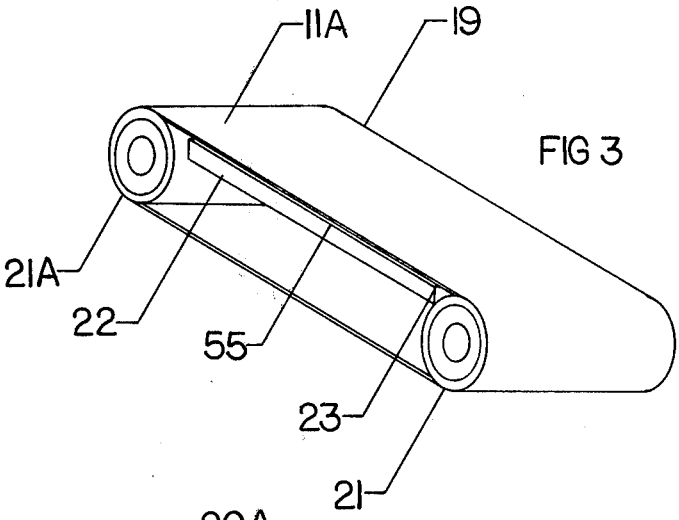
FIG. 3 is a perspective view displaying two drums carrying an abrasive belt with a flat surface platen beneath the belt.

In FIG. 3, a belt assembly 19 generally consists of a drive wheel or pulley 21, a tension wheel or pulley 21*a*, an abrasive covered belt 11*a*, and a flat platen 55 located beneath the belt so that pressure may be applied to the item being finished. It has been found by experience that a flat platen will cause more finishing to take place near the ends of the platen 22, 23 and result in heat buildup in these areas.

Figure 3A:
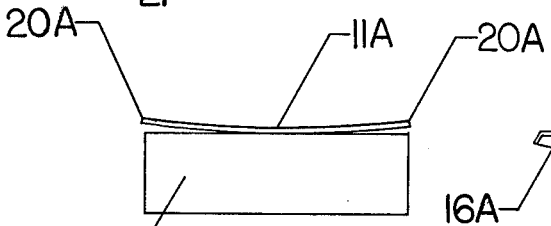
FIG. 3*a* is an end view of FIG. 3 showing curling on the edges of the abrasive belt.
Figure 3B:
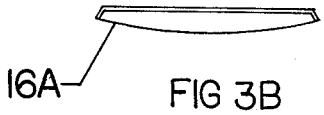
FIG. 3*b* is an end cross section of a ski displaying the finished ski bottom which is convex due to the curling on the edges of the abrasive belt.

A further complication which is caused by using a flat platen is shown in FIG. 3*a* wherein the edges 20*a* of belt 11*a* will curl upward with the result being a convex finish 16*a*, FIG. 3*b*, on the bottom of the ski. Not only is this convex finish undesirable but it is also impossible to accurately refinish the edges of skis when there is a convex bottom surface on the ski.

Figure 5:
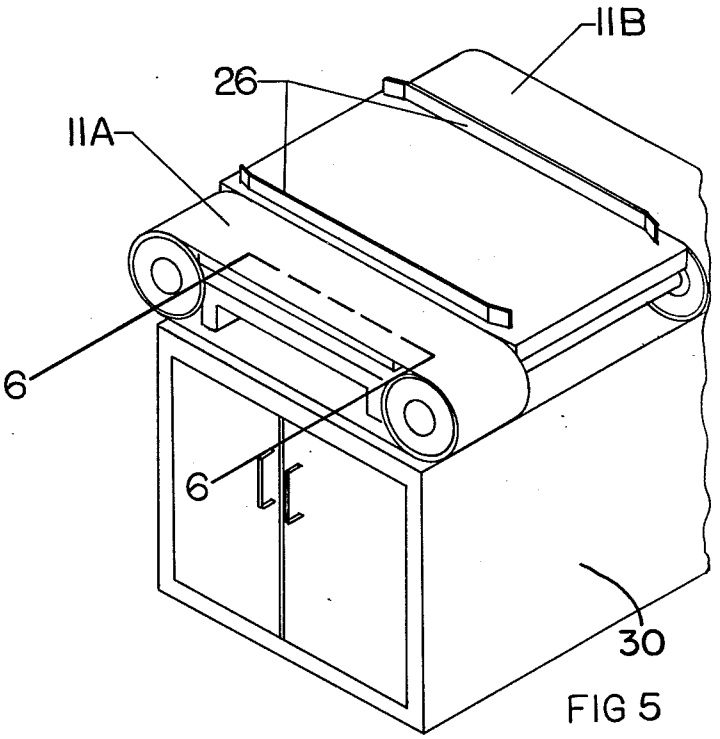
FIG. 5 is a perspective view of a machine used to refinish ski bottoms and having, in parallel, two sanding belts.
Figure 6:
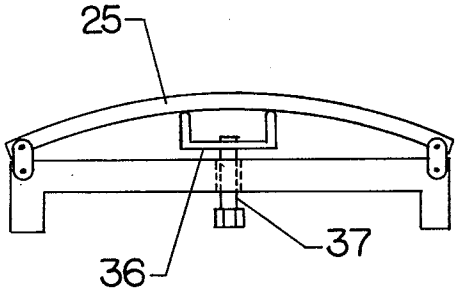
FIG. 6 is a break away end view of the curved platen in FIG. 5 at section 6—6.
Figure 4:
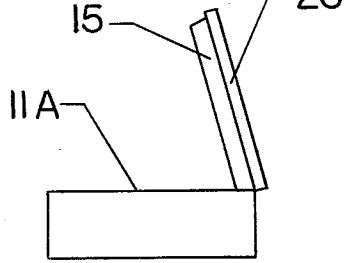
FIG. 4 is an end view of a drum and abrasive belt but also showing a guide which is used when refinishing ski edges.
Figure 4A:
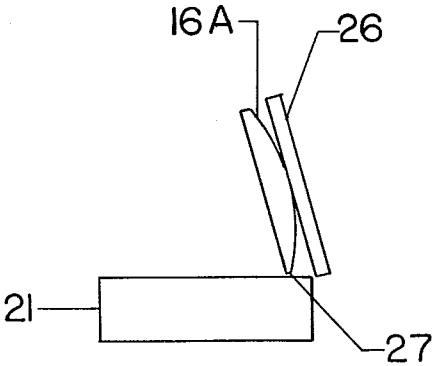
FIG. 4*a* is an end view similar to FIG. 4 but displaying the guide and a ski with a convex finished bottom surface.

FIGS. 4 and 4*a* illustrate a guide 26, also see FIG. 5, that is used to assist in accurately refinishing the edges of skis. If the bottom edge of the ski is convex 16*a*, it would be impossible to hold the ski firmly against the guide 26 so as to finish ski edge 27 at an accurate desired angle.

Note that in FIG. 4, the ski 15 has a flat bottom surface, therefore, the sides can be refinished at an accurate angle since the bottom of ski 15 rests firmly against guide 26.

In FIG. 5, the apparatus, 30, for refinishing items contains two abrasive covered belts 11*a* and 11*b*. Note that refinishing is better accomplished by first using a coarse grit abrasive and finally a finer grit abrasive. This is why the two belt assemblies are preferred.

FIGS. 6, 7, 7*a* and 7*b* show some embodiments for curving platen 25 in an adjustable manner. By being able to curve the platen, the belt will not curl at its edges, there is no predominate surface contact areas, and a greater bite is possible with all of the above advantages resulting in a flat refinished surface containing no signs of "washboarding", concavity or convexity. It has been found that greater diameter drum type wheels or pulleys tend to do a much better refinishing job and by analysis of an adjustable curvature platen, one can visualize that the curved surface of the platen simulates a portion of an arc of a wheel of enormous diameter.

Various means for adjusting the curvature on the platen are shown as 36, 36*a*, 36*b* and 36*c*. These elements are somewhat similar in that an adjustable bolt arrangement 37 is used to raise or lower the support elements 39, 59, 69. Multiple support elements can be used and FIG. 7*b* incorporates rollers 38 on top of the support elements rather than use of curved upper surfaces.

Figure 8:
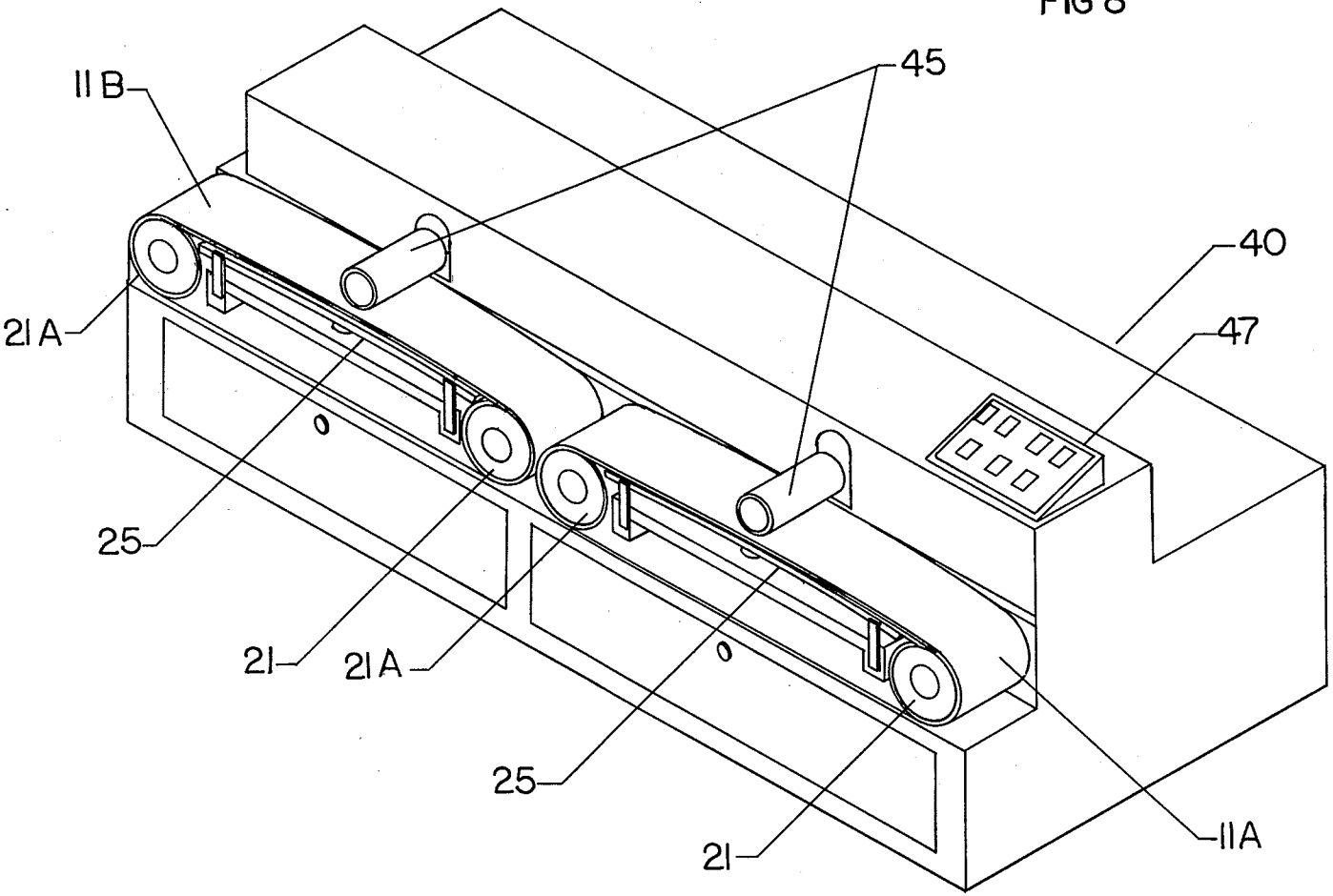

FIG. 8 displays an apparatus 40 which is similar in principal to the apparatus in FIG. 5, but the machine is essentially automatic in that drive rollers 45 automatically feeds the ski over abrasive covered belts 11*a*, 11*b*. The drum type wheels or pulleys, belt, and platen cooperate as previously explained with the only difference being that the belt assemblies are in a series relationship rather than in a parallel relationship. A control panel 47 would be customary.

The foregoing illustrate embodiments of this invention but is in no manner meant to limit the scope of this invention.

I claim:

1. An apparatus for abrasively finishing or dressing ski surfaces, a sanding device comprising: a frame; a motor attached to said frame; spaced pulleys supported by said frame and at least one pulley driven by said motor; an abrasive belt located about said pulleys and the abrasive portion facing outward; an elongated, flat backing element located immediately beneath the working area of said belt, and located between the pulleys, means pivotally attaching each end of the backing element directly to said frame, the backing element having sufficient resistance against flexing when subject to workloads but resilient enough to flex when subject to a mechanical means to flex; means to flex a center portion of the backing element in a convex configuration, as would be seen from a side view, comprising a device which is affixed to said frame and makes cooperative contact with the center portion of the backing element, said device being telecopically adjustable toward and away from said backing element; and, guide means located at the working area for guiding the edge of the ski against the abrasive belt to provide for accurately refinishing the edge of the ski.

* * * * *